US005642805A

United States Patent [19]

Tefft

[11] Patent Number: 5,642,805

[45] Date of Patent: Jul. 1, 1997

[54] INPUT DEVICE LOCK

[76] Inventor: Brian Tefft, 2121 W. Main #3114, Mesa, Ariz. 85202

[21] Appl. No.: 542,391

[22] Filed: Oct. 12, 1995

[51] Int. Cl.[6] ..... H01H 27/06

[52] U.S. Cl. ..... 200/43.08; 200/43.04

[58] Field of Search ..... 200/43.04, 43.05, 200/43.01, 43.08, 43.11

[56] References Cited

U.S. PATENT DOCUMENTS

| | | | |
|---|---|---|---|
| 1,654,511 | 12/1927 | Galusha | 361/192 |
| 2,759,159 | 8/1956 | Teetor . | |
| 2,856,474 | 10/1958 | Norris . | |
| 4,074,550 | 2/1978 | Rowlings | 200/43.22 |
| 4,107,784 | 8/1978 | Van Bemmelen | 364/900 |
| 4,185,179 | 1/1980 | Suzuki | 200/44 |
| 4,294,380 | 10/1981 | Rankin | 221/195 |
| 4,297,569 | 10/1981 | Flies | 235/443 |
| 4,326,125 | 4/1982 | Flies | 235/443 |
| 4,333,328 | 6/1982 | Platt | 70/278 |
| 4,404,435 | 9/1983 | Bonacci | 179/189 |
| 4,436,993 | 3/1984 | Flies | 235/382 |
| 4,446,708 | 5/1984 | Ely | 70/166 |
| 4,647,734 | 3/1987 | Dana | 200/43.06 |
| 4,647,735 | 3/1987 | Sicher | 200/43.08 |
| 4,667,307 | 5/1987 | Porcher | 364/900 |
| 4,796,007 | 1/1989 | Hey's Jr. | 341/31 |
| 4,890,006 | 12/1989 | Huang | 307/112 |
| 4,924,686 | 5/1990 | Vonlanthen | 70/277 |
| 4,942,606 | 7/1990 | Kaiser | 380/4 |
| 4,956,825 | 9/1990 | Wilts | 368/9 |
| 4,975,550 | 12/1990 | Panchisin | 200/43.01 |
| 5,034,576 | 7/1991 | Dalebout | 200/43.04 |
| 5,070,219 | 12/1991 | Grosskrueger | 200/43.008 |
| 5,077,991 | 1/1992 | Stickel | 70/58 |
| 5,190,466 | 3/1993 | McVey | 439/304 |
| 5,202,914 | 4/1993 | Kim et al. | 379/97 |
| 5,311,397 | 5/1994 | Harshberger et al. | 361/683 |

*Primary Examiner*—David J. Walczak
*Attorney, Agent, or Firm*—Parsons & Goltry; Robert A. Parsons; Michael W. Goltry

[57] ABSTRACT

An input device lock and method for preventing unauthorized access to the computer. The device is a lock switch that selectively enables or disables the line that effectuating data flow between the input device and the computer. Any input device may be selectively disabled using the present invention including a keyboard, mouse, track ball, joy stick, light pen, or other hand-held controller for example. Depending on the computer's configuration, the data flow-effectuating line is known as the data line, input/output line, signal line, or clock line. When the flow-effectuating line is disabled by this device, no data is transmitted from the input device to the computer and therefore access to the computer is controlled. No other wires inside the cable are affected; in particular, the power and ground lines are not broken. The lock switch is the style that allows the key to be inserted or removed only when the lock switch is in the input device disabled state.

12 Claims, 3 Drawing Sheets

INPUT DEVICE LOCK

BACKGROUND OF THE INVENTION

This device relates generally to a circuit breaker for a computer cable. More particularly this device relates to a lock switch for enabling and disabling the line that carries data between an input device and a computer, such as a keyboard or mouse, thereby controlling access to the computer while leaving it running.

The use of computers has become increasingly popular. In addition to privately-used computers, computers are now being provided for commercial public use. This satisfies the need for those who do not have their own computers or who need particular software applications that are too costly to purchase for only occasional personal use. As more information and software is stored on computers, a need arises to protect this information from unauthorized access. For example, proprietors desiring to rent computers to users on a time-share basis must be able to limit or monitor the amount of time the computer is in use. A convenient method of controlling this is by limiting access to the computers.

Another situation requiring preventing unauthorized access is in the case of computers used to demonstrate software. Vendors have a need to prevent individuals from accessing, and potentially vandalizing or pirating, demonstration software until a trained attendant is available to assist them. In both these situations it is desirable to leave the computer running while concurrently preventing a user from using it. Leaving the computer on allows the software programs to continue to run, thereby permitting quick start-up when desired. Leaving the computer on also allows messages, instructions, or advertising to show on the monitor. This is particularly desirable for commercial settings.

A variety of devices have been used to prevent unauthorized access to computers. One method of access control is provided by a password system in the computer's software. This approach is disadvantageous, however, in that software passwords can be lost, bypassed, or divulged. Other devices known in the art for controlling access to a computer include mechanical devices that cover the computer's power switch, disk drive, or keyboard. This approach is disadvantageous in that mechanical covers are cumbersome and necessarily unique to the ever-changing physical configuration of the components. Both of these approaches are inconvenient and particularly unsuitable to the commercial use market.

Internal keyboard locks are known in the art and work by employing an electrical switch inside the computer that disables the function of the keyboard. Internal keyboard lock switches using a round, soda machine-style key are common for IBM-compatible personal computers. Such switches allow the key to be removed from the lock in either the enable or disable position. These devices are disadvantageous because users can unlock the keyboard and remove the key from the lock switch, leaving the computer vulnerable to unauthorized access. Furthermore, when these devices are turned to the off position, the computer may not continue to run. Re-start may be time-consuming and may cause unpredictable data loss.

U.S. Pat. No. 4,975,550 to Panchisin discloses an external keyboard lock that encases the keyboard port of a computer. This device has a housing that mounts to the surface of the computer surrounding the port. A key switch provided on the wall of the housing switches the power supply line to the keyboard, thereby selectively enabling or disabling the keyboard. The Panchisin device is disadvantageous because it must be permanently mounted over the keyboard port to avoid unauthorized users from circumventing access control. As the size of computers and the space between ports decreases, it may not be possible to mount the Panchisin device over the keyboard port without covering other ports on the computer. However, making the device detachable to use adjacent ports destroys the device's functionality.

More importantly, many modern computer operating systems fail to function if a keyboard is not properly attached to the keyboard port. If the power to the keyboard is shut off, the computer may be unable to acknowledge that the keyboard is still attached. By switching the power supply line to the keyboard, the Panchisin device not only disables the function of the keyboard, but the device also disables the function of the computer's operating system. This is disadvantageous because continued unattended operation of the computer, alone or as a server for other computers, may be desired while preventing unauthorized access to the computer via the keyboard.

Therefore, it is an object of this invention to provide a security device that will prevent unauthorized access to a computer. It is another object of this invention to provide a security device that disables the input device but allows continued operation of the computer. It is yet another object of the present invention to provide a security device that allows a key to be inserted and removed only when the input device is in the disabled state. It is yet a further object of the preset invention to provide a security device that switches only the line effectuating data flow of the input device cable and does not switch the power source. It is a another object of this invention to provide a security device that mounts to the cable of an input device.

SUMMARY OF THE INVENTION

This device is an input device lock and method for preventing unauthorized access to the computer. The device is a lock switch that selectively enables or disables the line that effectuating data flow between the input device and the computer. Any input device may be selectively disabled using the present invention including a keyboard, mouse, track ball, joy stick, light pen, or other hand-held controller for example. Depending on the computer's configuration, the data flow-effectuating line is known as the data line, input/output line, signal line, or clock line. When the flow-effectuating line is disabled by this device, no data is transmitted from the input device to the computer and therefore access to the computer is controlled. No other wires inside the cable are affected; in particular, the power and ground lines are not broken. The lock switch is the style that allows the key to be inserted or removed only when the lock switch is in the input device disabled state.

The lock switch has an input device enabled state and an input device disabled state that allow and prevent data to be transmitted from the input device to the computer, respectively. For Macintosh configured computers, the line known as the data or ADB line is cut and attached to the two electrical terminals of the lock switch. The lock switch is closed and completes the circuit of the data line in the input device enabled state. The lock switch is open and breaks the circuit of the data line in the input device disabled state. For IBM®-compatible configured computers, data transmission from the input device to the computer is selectively disabled via circuitry which holds the voltage of the data line at a constant value when the lock switch is in the input device disabled state, known as the clock line. If the input device uses a clock line when transmitting data to the computer, the clock line instead of the data line of the cable is controlled by the lock switch as described above.

DESCRIPTION OF THE PREFERRED EMBODIMENTS

Figure 1:
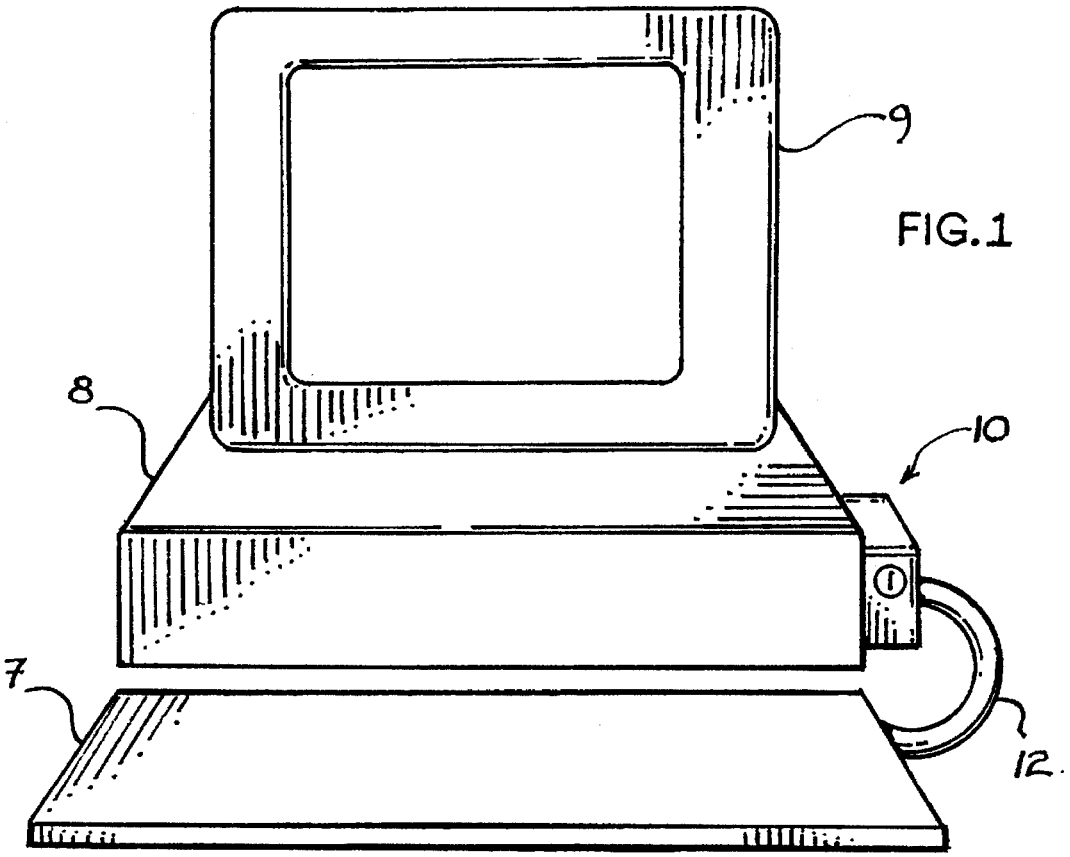
FIG. 1 illustrates the present invention attached to a computer and a keyboard.

Please refer to the accompanying FIGS. 1–6 where like numerals refer to like parts throughout the drawings. The input devices controlled by the present invention include a keyboard, mouse, track ball, joy stick, light pen, or other hand-held controller. The input device lock may be connected to any computer including a mainframe, mini computer, workstation, micro or personal computer, video game or digital stereo system. For simplicity, FIG. 1 illustrates the preferred embodiment of the input device lock, denoted generally as 10, attached between a computer 8 and a keyboard 7 on cable 12. A monitor 9 is also connected to the computer 8.

Figure 2:
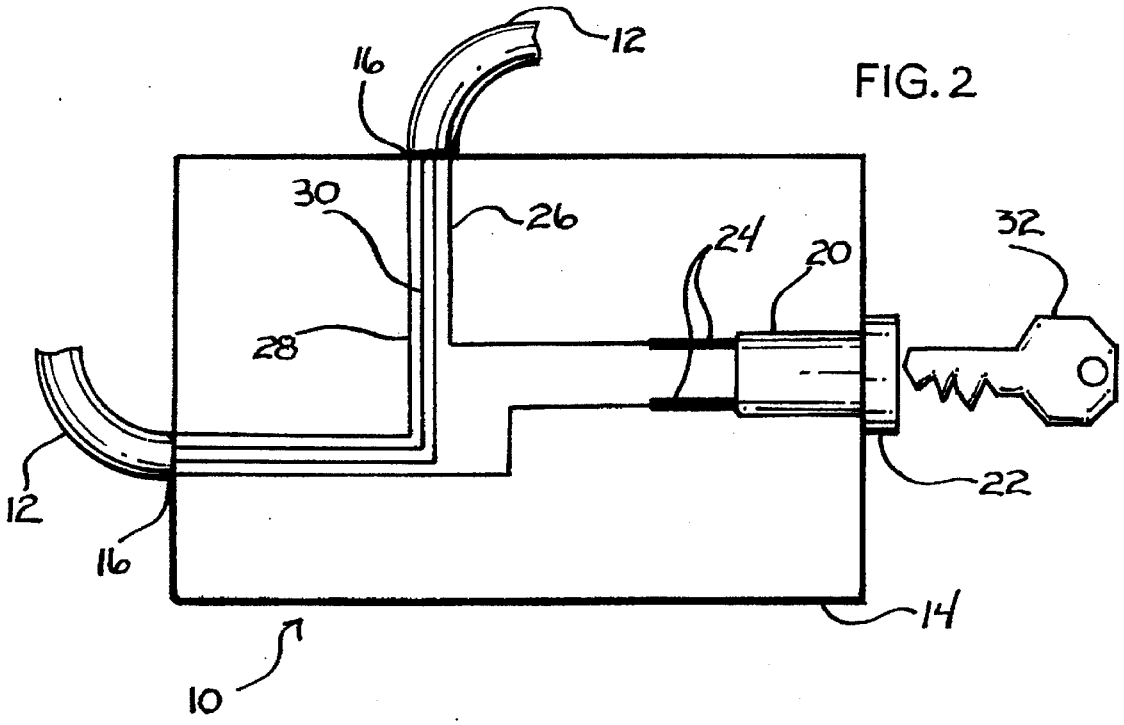
FIG. 2 is a top section view of a computer keyboard lock according to the present invention along line 2—2 of FIG. 3.

As shown in FIG. 2, the keyboard lock 10 attaches to the cable 12 that connects the keyboard 7 to the computer 8. To prevent tampering with the lock 10, it is encased in an enclosure 14 that surrounds a portion of the keyboard cable. A lock switch 20 straddles the enclosure 14 such that a key receiving portion 22 of the lock switch 20 is outside the enclosure 14 and electrical terminals 24 of the lock switch 20 are inside the enclosure 14. Several wires, typically between four and eight, are bundled inside the cable 12, each wire performing a different function. A power line 28 and a ground line 30 run through the cable 12, and at least one wire effectuating data flow 26. The lines effectuating data flow are known in the art as the data line, input/output line, signal line, ADB line or clock line. To install the present device, the data-effectuating line 26 of the keyboard cable 12 is cut and the newly created ends are attached to the electrical terminals 24 of the lock switch 20 inside the enclosure 14. The enclosure 14 protects the electrical terminals 24 and prevents unauthorized tampering. The enclosure 14 can be mounted to the cable alone, or to the computer, keyboard, or other surfaces. A mouse or other input devices may be similarly disabled using the present invention.

Figure 3:
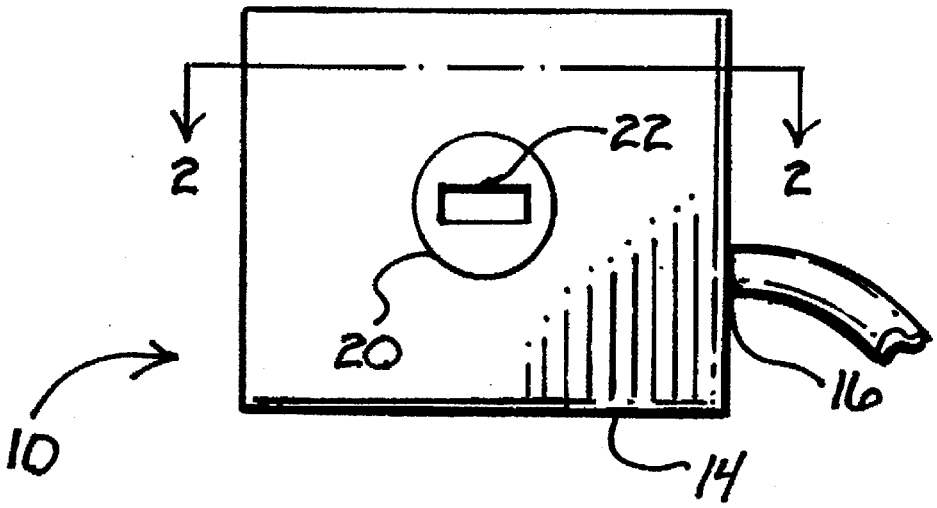
FIG. 3 is a front elevation view of the computer keyboard lock in an open position.
Figure 4:
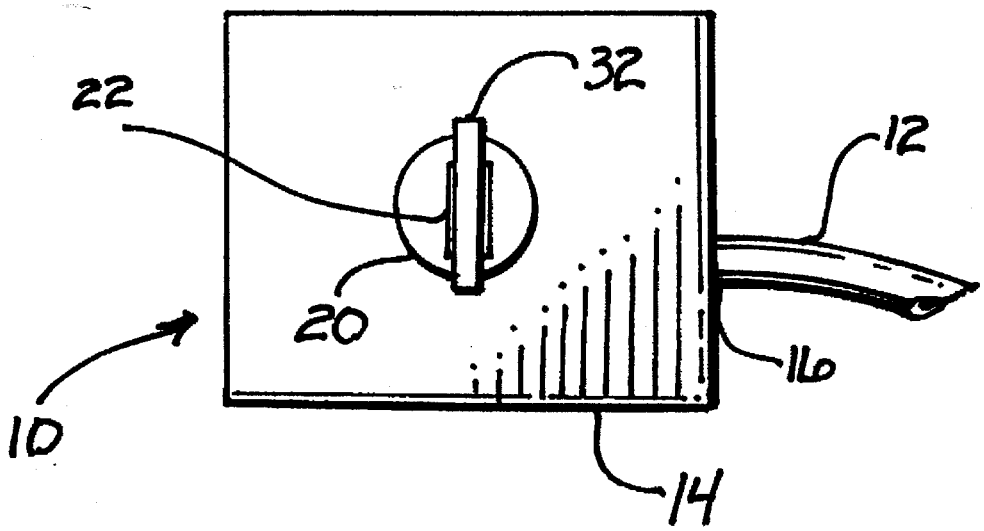
FIG. 4 is a front elevation view of the computer keyboard lock of in a closed position.

The lock switch 20 has a first state, as shown in FIG. 3, that breaks the circuit of the data-effectuating line 26. This state is also referred to as the keyboard disabled state or an open or off position. FIG. 4 shows the switch in a second state, known as the keyboard enabled state or closed or on position, that completes the circuit of the data-effectuating line 26. The key receiving portion 22 of the lock switch 20 accepts a key 32 only if the lock switch 20 is in the open position. After the key 32 is inserted, the lock switch 20 can be switched between the open position and the closed position. While the cable 12 may contain other lines, such as a power line 28 and a ground line 30, only the line carrying the data is switched. The key receiving portion 22 prevents the key 32 from being removed while the lock switch 20 is in the closed position.

Because only the line effecting data flow is switched, the power between the computer and the keyboard remains on. This allows the computer to function as a server or to display messages on screen even when the keyboard is disabled from sending data to the computer. With the use of the present device, the computer does not shutdown when the keyboard is disabled and therefore does not need to reboot when the keyboard is enabled. The data transmitted from the input device is interrupted when the lock switch is in the first state but is unaffected when the lock switch is in the second state, and the computer acknowledges that the input device is properly connected while the lock switch is in either state.

For simplicity, a toothed key 32 is shown and described. However, the key used to switch the lock may be any other device that causes the data circuit to be closed. For example, a more sophisticated credit card or punch card key may be inserted into a complementary card reader, causing an electronic switch to complete the circuit. As with a toothed key, the lock switch allows the card to be inserted or removed only when the lock switch is in the open position or keyboard disabled state. After the key is inserted, the lock switch can be switched between the input device disabled state and the input device enabled state. The key receiving portion prevents the key from being removed while the lock switch is in the input device enabled state.

Figure 5:
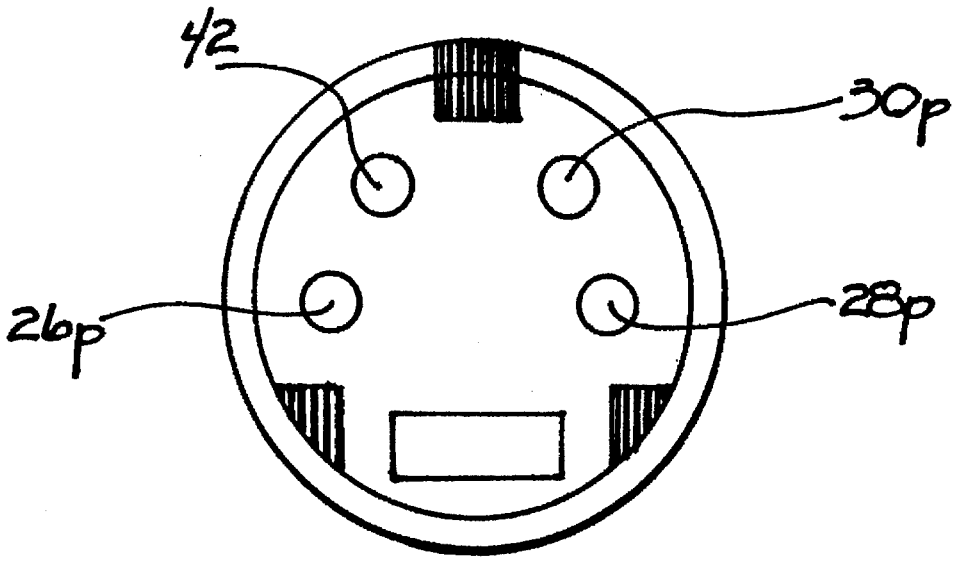
FIG. 5 illustrates an end view of the male jack used to connect a keyboard or mouse to a Macintosh computer.

Macintosh® computers are often used in commercial setting because they are simple to use and user-friendly. FIG. 5 illustrates an end view of the male jack used to connect a keyboard or mouse to a Macintosh computer. The ADB pin **26*p* connects to the data-effectuating line 26. The power-on pin 28*p*, 5 volt pin 42, and ground pin 30*p* connect to the power-on wire, 5 volt wire, and ground wire, respectively. When used on a Macintosh® with this pin configuration, the present device interrupts the data flowing through ADB pin 26*p*** only.

Figure 6:
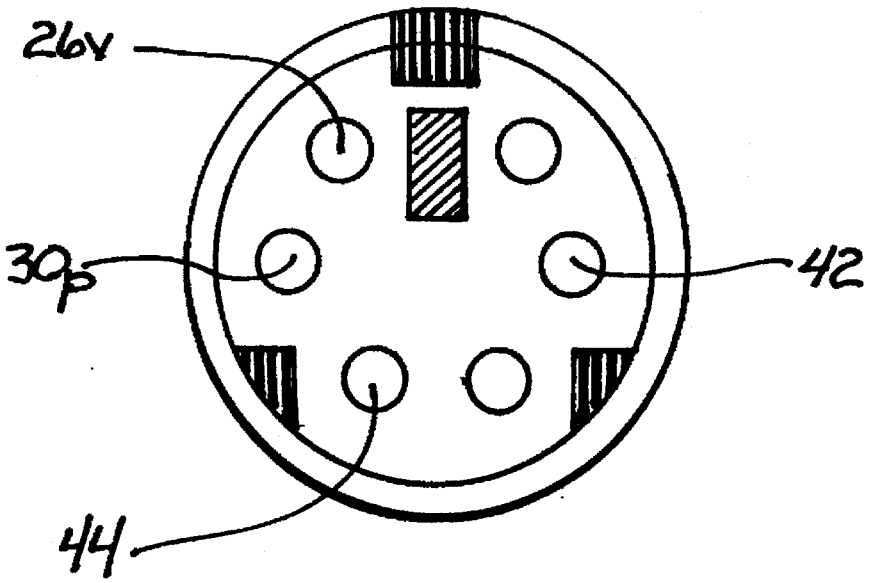
FIG. 6 illustrates an end view of the male jack used to connect a keyboard or mouse to an IBM PS/2 computer.

Similarly, IBM® computers are often used in commercial settings. FIG. 6 illustrates an end view of the male jack used to connect a keyboard or mouse to an IBM computer. The 2.5 volt pin **26*v* connects to the data-effectuating line 26. The 3 volt pin 44, 5 volt pin 42*p* and ground pin 30*p* connect to the 3 volt wire, 5 volt wire and ground wire, respectively. When used on an IBM computer with this pin configuration, the present device interrupts transmission on the 2.5 volt pin 26*v*** only.

The present invention can be used with many other cable, port, and jack configurations. Because communication between a keyboard, mouse, or other input device and a computer is typically serial, only one data or clock line is used in the cable connecting the input device to the computer. Thus, the present device can be used with these different configurations by interrupting only the line enabling the data to flow between the keyboard and computer.

The preferred method of controlling access to a computer is to hold the keyboard lock keys in a central location of a computer facility. Each computer is disabled until a key 32 is used to enable its keyboard. A computer user picks up a key 32 from the central location, unlocks the computer keyboard with the key 32, uses the computer, locks the keyboard when finished, and removes the key 32. The computers are not left enabled because users, when finished, have to remove the key 32 (and disable the keyboard) and return it to the central location. Messages on the monitor screen indicate when the keyboard is disabled and instruct the potential user to obtain a key.

Alternatively, a trained attendant may possess the keys to the input devices of demonstration computers or video games. When a potential customer approaches a computer demonstrating software, the attendant uses a key to enable the input device and give a personal demonstration of the software. Because the key must be removed after the demonstration, the keyboards or other input devices of unattended computers are disabled and prevent vandals from disrupting or destroying the demonstration software. The computer and monitors stay powered up, however, so instructions or advertisements about the software are still displayed.

Another method of use of this device allows a user to leave the computer for eventual return, without needing to dose files or shut down the computer. This benefit is available because the computer is still running even when the key is removed. In practice, a user desiring to temporarily leave the computer—for example to make a phone call from a public computer facility—switches the keyboard to the off position and removes the key, thereby leaving the program running but preventing unauthorized use. The user then returns and inserts the key, continuing the work in the current application without having to reopen the documents or applications the user was working with.

The objects of this invention are achieved through the aforementioned improvements. Although certain preferred embodiments have been shown and described, it should be understood that other embodiments and modifications that achieve these objects may be apparent to those of skill in the art and are within the scope of the appended claims.

I claim:

1. A device to prevent unauthorized use of a computer comprising:

a switch connected to a line effectuating data flow from an input device, the switch movable to and from a first condition wherein data may be transmitted from the input device to the computer, and a second condition wherein the data is prevented from being transmitted from the input device to the computer, wherein the operation of the computer remains unaffected when the switch is moved to the second condition.

2. The device according to claim 1 wherein the switch is enabled by a key, the key being detachably insertable into the switch for controlling the selection of the first condition and the second condition.

3. The device according to claim 2 wherein the key is insertable into the switch only when the switch is in the second condition.

4. An input device lock comprising:

a) a lock switch connected in series to a line that effectuates data flow between an input device and a computer; and b) a key received by the lock switch, wherein the lock switch is enabled only when the key is received by the lock switch, a computer receives data transmitted from an input device only when the key is received by and enables the lock switch, and the operation of the computer remains unaffected when the lock switch is disabled.

5. A computer security device for selectively interrupting data transmitted from an input device to a computer along a cable having a first and second end, a power line and a line effectuating data transmission from the input device to the computer comprising:

a) an enclosure affixed to and surrounding a portion of the cable between the first and second ends;

b) a lock switch electrically connected to the line effectuating data transmission in the keyboard cable; the lock switch having a first state that disables the lie and a second state that enables the line; and c) a key insertable into and removable from the lock switch only if the lock switch is in the first state, the key allowing the lock switch to be switched between the first and second states when inserted into the lock switch;

whereby data transmitted from the input device is interrupted when the lock switch is in the first state but is unaffected when the lock switch is in the second state, and the computer acknowledges that the input device is properly connected while the lock switch is in either state since the power line is uninterrupted.

6. A computer security device according to claim 5 wherein the line effectuating data transmission is a clock line.

7. A computer keyboard lock for switching a line effectuating data transmission of a computer keyboard cable comprising:

a) a lock switch connected to the line effectuating data transmission of the keyboard cable, the lock switch having a key receiving portion enabling switching between an on position and an off position;

b) a key received by and switching the lock switch between the on position and the off position, the key insertable into and removable from the key receiving portion only when in the off position; and c) a rigid enclosure surrounding a portion of the keyboard cable where the lock switch connects to the line carrying the data, the lock switch mounted to the enclosure such that the lock switch connection to the line effectuating data transmission is inside the enclosure and the key receiving portion is outside the enclosure;

whereby a computer keyboard is unable to send or receive data but is still acknowledged by a computer as being connected when the key receiving portion is in the off position, no lines in the keyboard cable other than the line effectuating data transmission are affected, and the computer keyboard functions normally when the key is inserted into the key receiving portion and is switched to the on position.

8. The device according to claim 7 wherein the rigid enclosure is mounted to the computer.

9. The device according to claim 7 wherein the line effectuating data transmission is a serial line of a computer input device.

10. A method for controlling access to a computer, the steps comprising:

a) connecting a lock switch to a cable having a power line and a line effectuating data transmission, the cable coupling an input device to a computer, the lock switch being electrically connected to the line effectuating data transmission, the lock having an on position wherein data can be transmitted and an off position wherein data transmission is inhibited;

b) inserting a key into the lock switch;

c) switching the lock switch to the on position such that the computer keyboard functions normally and the key cannot be removed from the lock switch d) switching the lock switch to the off position; and e) removing the key from the lock switch in only the off position;

whereby the computer receives data from the keyboard only when the key is in the lock switch and the lock switch is in the on position, and the key can be inserted into and removed from the lock switch only when the lock switch is in the off position.

11. The method according to claim 10 further comprising the step of controlling access to the keys from a central location.

12. A method for temporarily preventing unauthorized access to a computer through a keyboard coupled thereto by a cable having a power line and a line effectuating data transmission, comprising the steps of a) inserting a key into a lock switch wherein the lock switch is connected to the line effectuating data transmission of the keyboard cable such that data transmission through the line effectuating data transmission is inhibited when the lock switch is in the off position;

b) switching the lock switch to an on position such that the keyboard functions normally and the key cannot be removed from the lock switch;

c) switching the lock switch to the off position; and d) removing the key from the lock switch in only the off position;

whereby the keyboard transmits data only when the key is in the lock switch and the lock switch is in the on position, and the key is insertable into and removable from the lock switch only when the lock switch is in the off position.

* * * * *